US005337429A

United States Patent [19]

Tucker

[11] Patent Number: 5,337,429

[45] Date of Patent: Aug. 16, 1994

[54] HEAD SUPPORT FOR BED-RIDDEN PATIENTS

[76] Inventor: Marilyn Tucker, 29255 S. Lakeshore Dr., Agoura, Calif. 91301

[21] Appl. No.: 104,776

[22] Filed: Aug. 9, 1993

[51] Int. Cl.[5] ..... A45D 19/04; A47C 20/02

[52] U.S. Cl. ..... 5/643; 5/640; 5/636; 5/622; 5/928; 4/516; 4/523

[58] Field of Search ..... 5/640, 643, 636, 638, 5/928, 622; 4/516, 517, 519, 523

[56] References Cited

U.S. PATENT DOCUMENTS

| | | | |
|---|---|---|---|
| 1,083,707 | 1/1914 | Sparenburg . | |
| 1,105,365 | 7/1914 | McQuhae . | |
| 1,244,535 | 10/1917 | Nutter . | |
| 1,817,625 | 8/1931 | Holmes . | |
| 2,451,653 | 10/1948 | Baeelon | 4/159 |
| 2,474,572 | 8/1948 | Brose | 4/159 |
| 2,658,512 | 11/1953 | Tcheong | 128/292 |
| 2,789,625 | 4/1957 | Christie | 4/523 X |
| 2,802,022 | 8/1957 | Wynkoop | 5/643 X |
| 3,026,537 | 3/1962 | Schnell | 4/159 |
| 3,363,620 | 1/1968 | Collins | 128/2 |
| 3,403,413 | 10/1969 | Calhoun et al. | 5/643 X |
| 3,608,103 | 9/1971 | Seid | 5/622 X |
| 3,733,620 | 5/1973 | Glintz | 4/159 |
| 4,584,731 | 4/1986 | Carter | 5/431 |
| 4,917,363 | 4/1990 | Evans et al. | 5/622 |
| 4,922,558 | 5/1990 | Porco | 4/523 |
| 4,956,881 | 9/1990 | Lindlet | 4/517 |

FOREIGN PATENT DOCUMENTS

| | | | |
|---|---|---|---|
| 17202 | of 1907 | United Kingdom | 5/643 |

*Primary Examiner*—Michael F. Trettel
*Attorney, Agent, or Firm*—Robert M. Wallace

[57] ABSTRACT

A device for supporting the head of a bed-ridden patient off an end of a bed during shampooing and cutting of the patient's hair. The device includes a frame with an open top, a series of straps traversing the open top of the frame, and a watertight collection tub disposed over a lower portion of the frame.

8 Claims, 2 Drawing Sheets

HEAD SUPPORT FOR BED-RIDDEN PATIENTS

BACKGROUND OF THE INVENTION

1. Technical Field

The present invention relates generally to an adjustable head support for use in the care of bedridden patients, and particularly to a head support to be used during the shampooing and cutting of the patient's hair.

2. Background Art

One of the difficult problems a bed-ridden patient has, whether in a hospital or home care, is getting their hair washed and cut. The current procedure for shampooing a patient's hair entails either the use of numerous towels and a protective chux, or a very uncomfortable hard plastic container, which fits painfully under the neck to catch the water. The amount of water used is usually so small, it is almost impossible to effectively clean the patient's hair. The experience is ineffective and totally uncomfortable. The current procedure for cutting a patient's hair, if it is done at all, is to simply cut the top and sides and leave the back uncut. Therefore, the patient does not get a complete haircut and hair is often left in the bed.

Hence, the is a need for a simple, inexpensive device specifically designed to conveniently and comfortably support the head of a bedridden patient during the shampooing and cutting of the patient's hair and to allow these procedures to be done in an efficient manner.

Accordingly, it is an object of this invention to provide such a simple, inexpensive device which conveniently and comfortably supports the head of a bed-ridden patient.

It is another object of this invention to provide a such a device which additionally allows the patient's hair to be washed in a comfortable and efficient manner, wherein adequate amounts of water can be used, and which also allows a patient's hair to be cut in a comfortable and efficient manner, including the hair on the back of the patient's head.

It is yet another object of this invention to provide a such a device which additionally collects the used water and cut hair, and which can be easily cleaned and conveniently stored when not in use.

SUMMARY OF THE INVENTION

The stated objectives are fulfilled by a device for supporting the head of a bed-ridden patient off an end of a bed during shampooing and cutting of the patient's hair. The device includes a frame with an open top, a series of straps traversing the open top of the frame, and a watertight collection tub disposed over a lower portion of the frame.

The frame is generally a block-shaped open faced structure constructed of tubular members. It includes a rectangular base, four legs extending perpendicularly upward from the base, a mechanism for adjusting the height of each leg, a top portion, and a support member connecting the pair of adjacent legs at the front of the frame. The support member is connected at a point approximately six inches below the top portion. The top portion includes a first member connected at its ends to respective top ends of the pair of adjacent legs at the back of the frame, a second member connected at its ends to respective top ends of a pair of adjacent legs such that the second member lies perpendicular to the first member and corresponds to one side of the frame, and a third member connected at its ends to respective top ends of a pair of adjacent legs such that the third member also lies perpendicular to the first member but corresponding to the opposite side of the frame. The frame is generally sized so that its height can be adjusted by the adjustment mechanism within a range such that the top portion is approximately even with the top of a mattress of a hospital-type bed. It is also wide enough and deep enough to accommodate the patient's head. The frame is made of a corrosion resistant material, such as PVC piping or stainless steel tubing.

The straps are positioned such that gaps exist between each strap and also between the rearmost strap and the back of the frame. These straps are made of a plastic webbing material.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENT OF THE INVENTION

The preferred embodiment herein described is not intended to limit the invention to the precise form disclosed. Rather, it is intended to explain the principles of the invention, it application and utilization, so as to enable others skilled in the art to make and use the invention.

Figure 1:
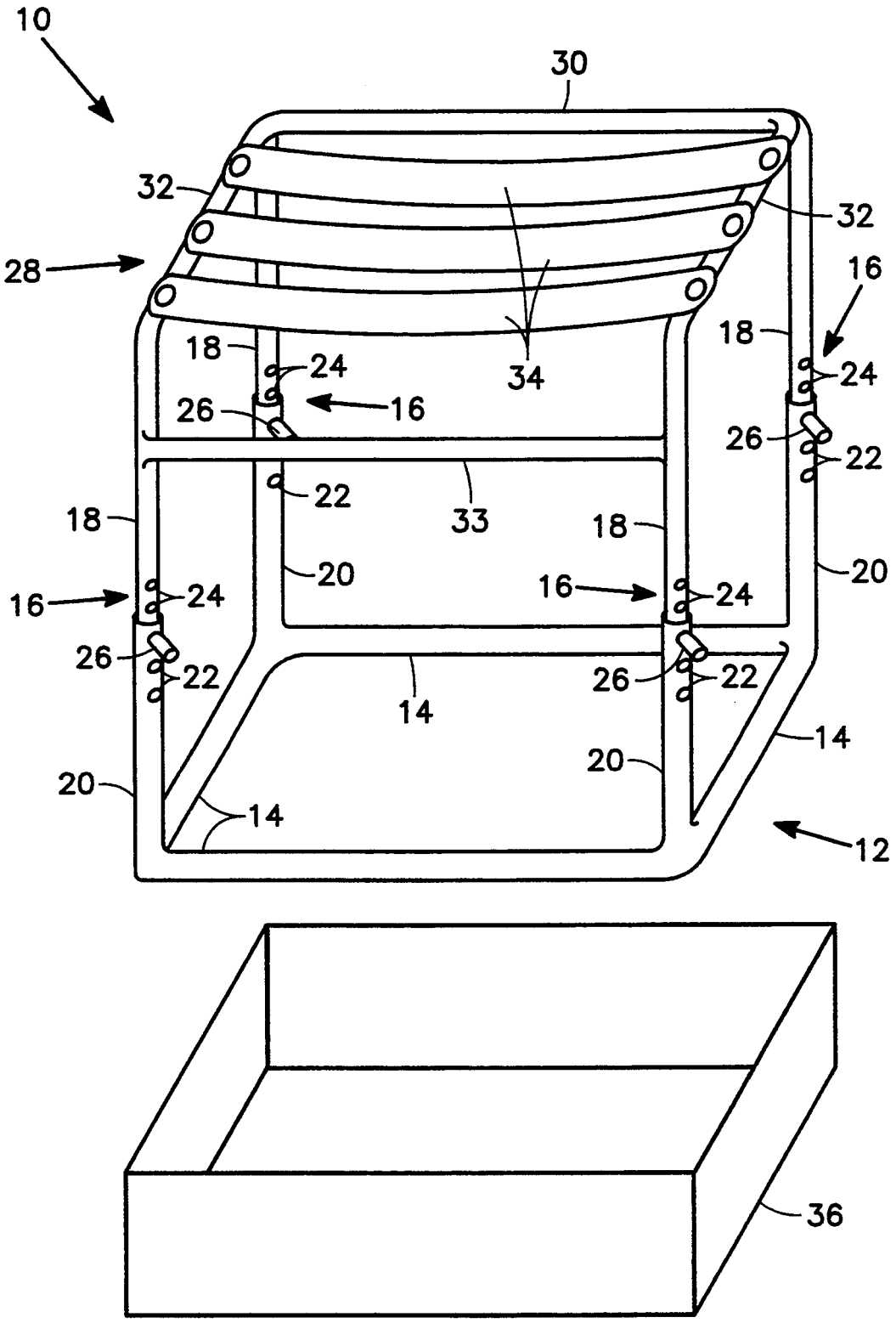
FIG. 1 is a perspective view of the head support of the present invention.

Referring to FIG. 1, the head support 10 is an open frame structure generally of a block shape. The base 12 is rectangular and made up of four tubular members 14 connected together at the corners. Extending perpendicular to the base 12 at each corner is an adjustable leg 16. Each of the four adjustable legs 16 includes an adjustment mechanism enabling the overall length of the legs 16 to be shortened or lengthened, thereby raising or lowering the height of the head support 10 as a whole. In the preferred version of the invention, the legs 16 are two-piece hollow tubes with an upper section 18 having a slightly smaller diameter such that it is installed within a lower section 20 and capable of being slid into and out of this lower section 20. The adjustment mechanism comprises a series of spaced holes 22 along the length of the lower leg section 20, and a series of circumferentially corresponding holes 24 along the length of the upper leg section 18. The height of the head support 10 is adjusted by raising or lower the upper leg sections 18 to a desired height wherein a hole 22 in each of the lower leg sections 20 matches up with a corresponding hole 24 in each of the upper leg sections 18. A pin 26 having a diameter slightly smaller than the holes 22, 24 in each leg section 18, 20 is then inserted through an aligned hole pair 22, 24 in each leg 16, thereby locking the legs 16 at the desired height. The top portion 28 of the head support 10 is formed by a first tubular member 30 connected at its ends to the top end of two adjacent legs 16, and second and third tubular members 32 each of which is respectively connected at its ends to the top end of two adjacent legs 16 such that the second and third tubular members 32 lie perpendicular to the first tubular member 30. The first tubular member 30 of the top portion 28 corresponds to the back of the support 10 and the second and third tubular members 32 correspond to the sides of the support 10. The top portion 28 is open at the front of the support 10. However, a support member 33 connects the two legs 16 facing the front of the support 10 approximately six inches below the top portion 28. There are also a series of three straps 34 connected at their ends to the second and third tubular members 32 of the top portion 28, respectively, and which perpendicularly extend between the second and third tubular members 32. The straps 34 are spaced such that there is a gap left between each strap 34, and between the first tubular member 30 and the rearmost strap 34.

Figure 2:
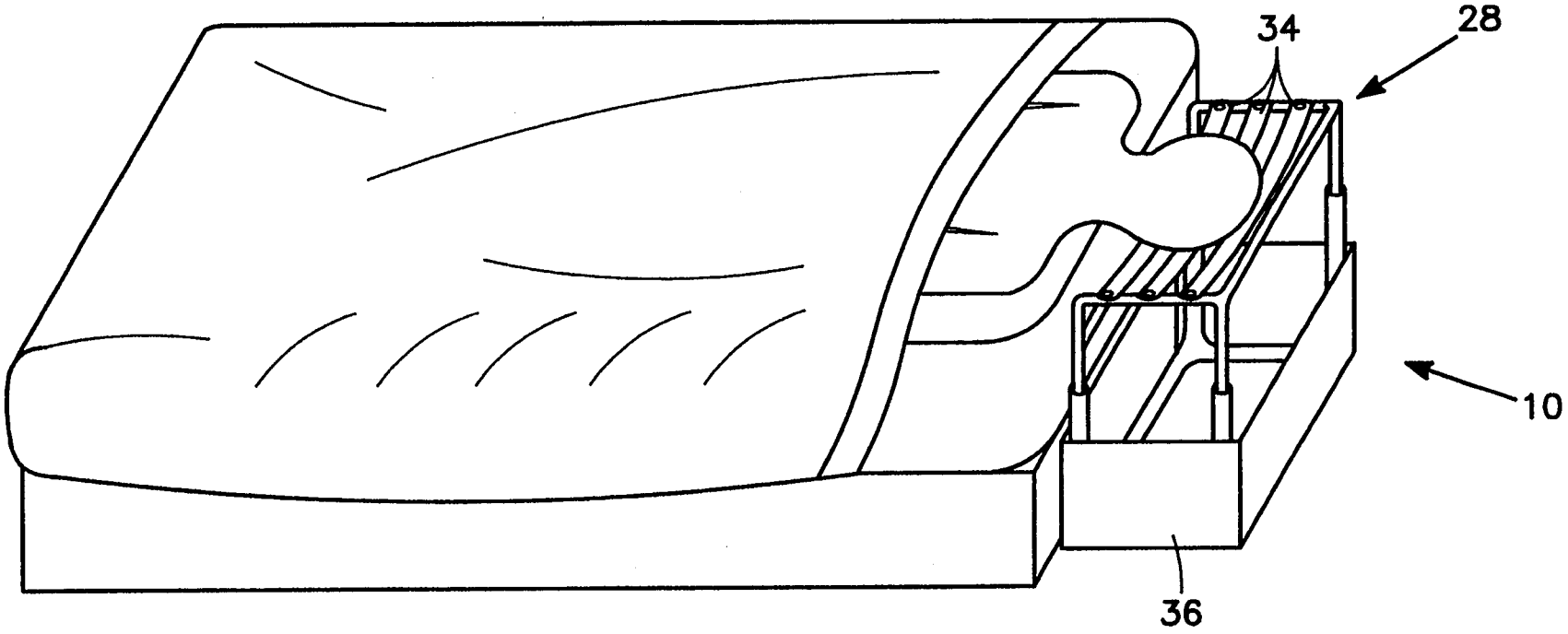
FIG. 2 is a perspective view of the head support shown in use supporting a patient's head.

Referring to FIG. 2, the head support 10 is generally sized so that its height can be adjusted within a range such that the top portion 28 is approximately even with the top of the mattress of a hospital-type bed. The support 10 is wide enough and deep enough to accommodate a patient's head. Preferably, the support 10, is mainly constructed of corrosion resistant materials such as PVC piping or stainless steel tubing. The PVC version would be light and inexpensive, and the stainless steel version would be durable. The straps 34 are preferably made of a plastic webbing material such as the material often used in outdoor lawn chairs. The interconnections between the components of the support 10 can made by any appropriate method. For instance, the PVC version can be assembled using standard PVC pipe connectors, or the stainless steel version can be welded together. The straps 34 can be attached via any appropriate method, such as a screw and washer.

The head support 10 is placed base end first into a generally rectangular collection tub 36, as shown in FIG. 1. The tub 36 is watertight and used to capture the water and hair from shampooing and haircutting. It is also sized to hold any reasonable amount of water used in shampooing the patient's hair.

A patient's hair is shampooed in the following manner using the present invention. A pull sheet, which is typically placed sideways under an incapacitated patient to allow a caregiver to slide the patient from side to side on the bed, is instead placed longways. This alternate placement allows the caregiver to move the patient lengthwise on the bed. The caregiver first lowers the head frame of the bed, as is typically possible with most hospital-type beds. The tub 36 is placed at the head of the bed and the head support 10 is placed inside with the front facing the bed. Next, the patient is pulled using the pull sheet so that his or her head clears the end of the bed and is cradled by the straps 34 of the head support 10. The patient's hair can now be shampooed in the normal manner, with the water used ending up in the collection tub 36. Once the patient's hair has been dried, the caregiver goes to the foot of the bed and using the pull sheet slides the patient off of the head support 10 and back into position on the bed.

A patient's hair is cut in the following manner using the present invention. The patient's head is placed on the support 10 as described above. The hair on the top and sides of the patient's head are cut in the normal manner. The hair on the back of the patient's head is cut by pulling sections of it through the closest gap in the straps 34, and then cutting it from below. The cut hair falls into the collection tub 36. After the haircut, the patient is returned to the bed as described above.

After use, the support 10 is wiped off and the contents of the collection tub 36 discarded.

Although the present invention has been described in considerable detail with reference to certain versions thereof, other versions and uses are possible. For instance, the head support 10 could be used to facilitate the performance of medical and dental procedures on a bed-ridden patient. In addition, when the head stand is not in use, the collection tub 36 can be inverted and placed over the top portion 28 of the support 10 and the bottom of the tub 36 would serve as a table top.

Therefore, the spirit and scope of the appended claims should not be limited to the description of the versions of this invention contained herein.

What is claimed is:

1. A device for supporting the head of a bed-ridden patient off an end of a bed during shampooing and cutting of the patient's hair, the device comprising:

a) a frame with an open top having a height such that the top of the frame is approximately at a same height as a top of a mattress of a hospital-type bed;

b) a plurality of straps traversing the open top of the frame for supporting the head of the bed-ridden patient off the end of the bed during shampooing and cutting of the patient's hair; and, c) a watertight collection tub disposed over a lower portion of the frame having sufficient size to hold fluid residue from shampooing of the patient's hair.

2. The device of claim 1 wherein the plurality of straps are positioned such that gaps exist between each strap and between an outermost strap and a back of the frame.

3. The device of claim 2 wherein the straps are made of a plastic webbing material.

4. The device of claim 1 further comprising:

means for adjusting the height of the frame so that the frame can be made approximately the same height as the top of the mattress of the hospital-type bed by adjusting the adjustment means.

5. The device of claim 4 wherein the frame comprises a block-shaped open faced structure constructed of tubular members including:

a) a rectangular base;

b) four legs extending perpendicularly upward from the base;

c) the height adjustment means comprises means for adjusting the height of each leg;

d) a top portion having, d1) a first member connected at its ends to respective top ends of a first pair of adjacent legs and corresponding to the back of the frame, d2) a second member connected at its ends to respective top ends of a second pair of adjacent legs such that the second member lies perpendicular to the first member, said second member corresponding to one side of the frame, and, d3) a third member connected at is ends to respective top ends of a third pair of adjacent legs such that the third member lies perpendicular to the first member, said third member corresponding to an opposite side of the frame; and, e) a support member connecting a fourth pair of adjacent legs corresponding to a front of the frame, at a point approximately six inches below the top portion.

6. The device of claim 5 wherein:

the frame is wide enough and deep enough to accommodate the patient's head.

7. The device of claim 5 wherein the frame is made of a corrosion resistant material.

8. The device of claim 7 wherein the corrosion resistant material is one of (i) PVC piping, and (ii) stainless steel tubing.

* * * * *